United States Patent [19]

Oeschger et al.

[11] Patent Number: 4,582,313

[45] Date of Patent: Apr. 15, 1986

[54] VACUUM BLOCK DOCUMENT FEEDER FOR INSERTING MACHINE

[75] Inventors: Frank A. Oeschger, Punta Golda, Fla.; William P. White, Stamford, Conn.

[73] Assignee: Pitney Bowes Inc., Stamford, Conn.

[21] Appl. No.: 698,284

[22] Filed: Feb. 4, 1985

[51] Int. Cl.[4] ..... B65H 5/30

[52] U.S. Cl. ..... 270/57

[58] Field of Search ..... 270/59, 57, 55; 271/93-94, 11-13, 90; 400/627

[56] References Cited

U.S. PATENT DOCUMENTS

| | | | |
|---|---|---|---|
| 2,644,686 | 7/1953 | Dann | 270/57 |
| 2,736,999 | 3/1956 | Rouan et al. | 270/57 X |
| 3,561,751 | 2/1971 | Dutro | 270/55 |
| 4,134,579 | 1/1979 | Polarek et al. | 270/57 X |
| 4,169,341 | 10/1979 | Roetter et al. | 270/57 X |
| 4,403,770 | 9/1983 | Ferguson et al. | 270/57 |

*Primary Examiner*—E. H. Eickholt

*Attorney, Agent, or Firm*—Lawrence E. Sklar; William D. Soltow, Jr.; Albert W. Scribner

[57] ABSTRACT

An improvement in a document feeder in an inserting machine, the inserting machine having a transport deck and being capable of nesting a plurality of sheet materials between the front and back covers of a booklet, and wherein the document feeder includes a demand feed roller. The improvement comprises a vacuum block located downstream of the demand feed roller and above the inserting machine transport deck, wherein one of the covers of a booklet is separated and raised when a booklet is fed out from the document feeder and passes under the vacuum block, thereby allowing other sheet materials assembled on the transport deck upstream of the document feeder to be nested between the front and back covers of the booklet.

6 Claims, 6 Drawing Figures

VACUUM BLOCK DOCUMENT FEEDER FOR INSERTING MACHINE

BACKGROUND OF THE INVENTION

The instant invention relates to inserting machines and more particularly to a vacuum block used in the document feeder for lifting and separating the front cover from the back cover of a booklet.

Inserting machines are used for assembling a plurality of sheet materials into a properly ordered packet and then inserting the ordered packet into a receptacle such as an envelope, a bag or a booklet located downstream thereof. In the case of a booklet having a front and a back cover comprising a relatively light material such as paper, it is necessary that the front and back covers be separated before the ordered packet can be nested within the front and back covers of the booklet. Heretofore, a typical approach for dealing with the need to separate the booklet covers involved the use of a separating bar. This approach required that the front cover of the booklet be wider than the back cover in order that the front cover, as it emerged from the feed rollers of the booklet feeder, would be prevented from falling to the transport deck therebelow. The back cover did fall to the transport deck since the booklet was fed to a point where the longer, front cover would be suspended by the separating bar while the shorter, back cover would pass and not be caught by the separating bar. In this position, with the front and back covers separated, the ordered packet of sheet materials which were assembled upstream are nested within the booklet located downstream.

The foregoing approach for separating booklet covers has worked well, but there is the drawback of the front and back covers of the booklet being of unequal width, which problem is overcome by the instant invention which separates the front and back covers of a booklet but which allows the front and back booklet covers to be of equal width.

SUMMARY OF THE INVENTION

Accordingly, the instant invention provides an improvement in a document feeder in an inserting machine, the inserting machine having a transport deck and being capable of nesting a plurality of sheet materials between the front and back covers of a booklet, and the document feeder having a demand feed roller. The improvement comprises a vacuum block located downstream of the demand feed idler roller and above the inserting machine transport deck, wherein one of the covers of a booklet is separated and raised when a booklet is fed out from said document feeder and passes under the vacuum block, thereby allowing other sheet materials assembled on the transport deck upstream of the document feeder to be nested between the front and back covers of the booklet.

BRIEF DESCRIPTION OF THE DRAWINGS

FIG. 3 is a perspective view of the vacuum block used with the booklet feeder in accordance with the instant invention;

DETAILED DESCRIPTION

Figure 1:
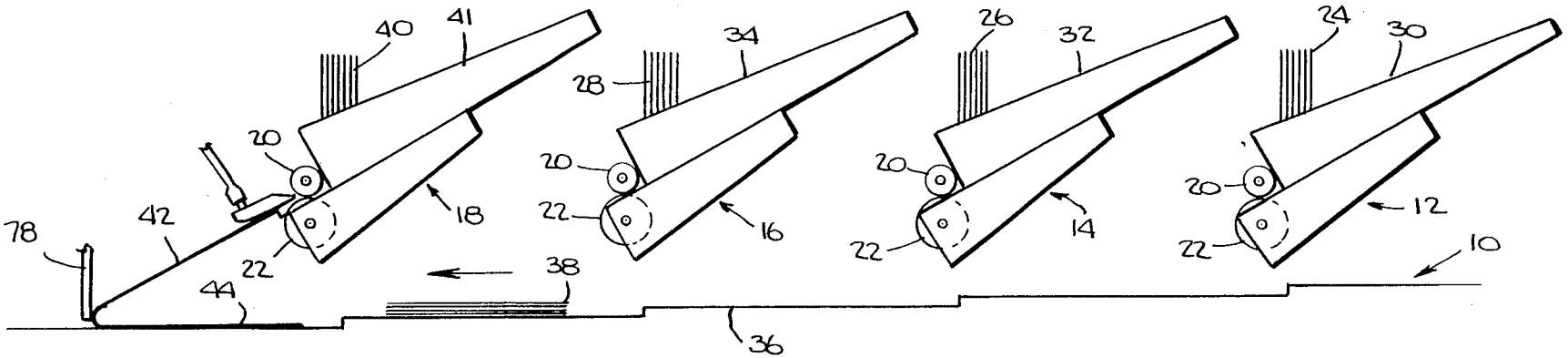
FIG. 1 is a schematic, side elevational view of an inserting machine having a booklet feeder according to the instant invention.

In describing the preferred embodiment of the instant invention, reference is made to the drawings wherein there is seen in FIG. 1 an inserting machine generally designated 10 having a plurality of document feeders 12, 14 and 16, downstream of which is a booklet feeder 18. Each of the feeders 12, 14, 16 and 18 includes a demand feed idler roller 20 and a demand feed driven roller 22. In the case of the document feeders 12, 14 and 16, the rollers 20 and 22 feed documents 24, 26 and 28 respectively from storage bins 30, 32 and 34 respectively. The documents 24, 26 and 28 are fed onto a transport deck 36 which, as seen in FIG. 1, steps down in the direction of transport as indicated by the arrow in FIG. 1 for each of the succeeding feeders 12, 14 and 16. A plurality of pusher bars and/or fingers (not shown) are used to move the documents 24, 26 and 28 along the transport deck 36 so that a packet of documents 38 is formed which can be inserted into a booklet 40.

The booklet feeder 18, located downstream of the document feeders 12, 14 and 16, includes a storage bin 41 for storing and supporting a plurality of booklets 40, each of which includes a front cover 42 and a back cover 44. Each of the booklets 40 is separated from the pack of booklets 40 in the storage bin 41 by a feeder roller 46 which urges the booklets 40 toward a separator roller 48 and separator stone 50, which feeds the booklets 40 seriatim to the demand feeder rollers 20 and 22 in conventional manner. The rollers 46 and 48 are driven by a gear 51 which is drivingly connected to the demand feed driven roller 22. The idler roller 20 is rotatably mounted on a translatable bracket 52. Similarly, the separator roller 48 is rotatably mounted on a second, translatable bracket 54. A threaded shaft 56 engages the bracket 52 and a housing member 58, and a coil spring 60 surrounding the threaded shaft 56 holds the bracket 52 in compression. Rotation of a knob 62 on the top of the shaft 56 effects the raising or lowering of the bracket 52 and hence the idler roller 20 in order that various thickness booklets 40 may pass between the demand feed rollers 20 and 22. Similarly, a threaded shaft 64 engages the bracket 54 and a second housing member 66, and a coil spring 68 surrounding the threaded shaft 64 holds the bracket 54 in compression. Rotation of a knob 70 on the top of the shaft 64 effects the raising or lowering of the bracket 54 and hence the separator roller 48 in order that various thickness booklets may pass between the roller 48 and the stone 50.

Figure 4:
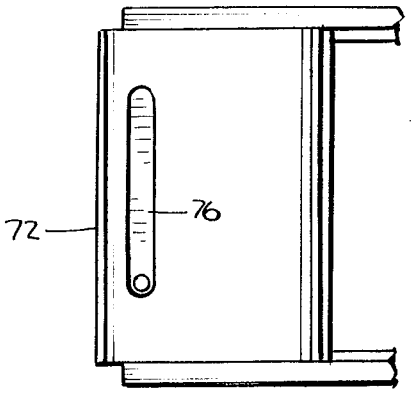
FIG. 4 is a bottom plan view of the vacuum block seen in FIG. 3.

Located downstream of the demand feed rollers 20 and 22 and situated above the transport deck 36 is a vacuum block 72 which is fixedly secured to the bracket 52. A hose 74 is secured to the vacuum block 72 and connects the vacuum block 72 to a conventional source of vacuum (not shown). Situated on the under side of the vacuum block 72 is a slot 76 (see FIG. 4) the function of which will be explained further hereinbelow.

Figure 5:
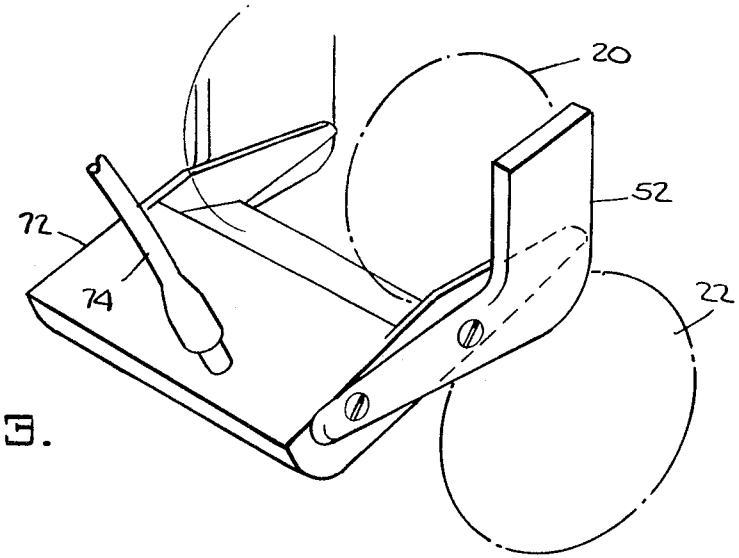
FIG. 5 is similar to FIG. 2 except it shows the top cover of the booklet being held up by the vacuum block prior to nesting of sheet material therein.
Figure 2:
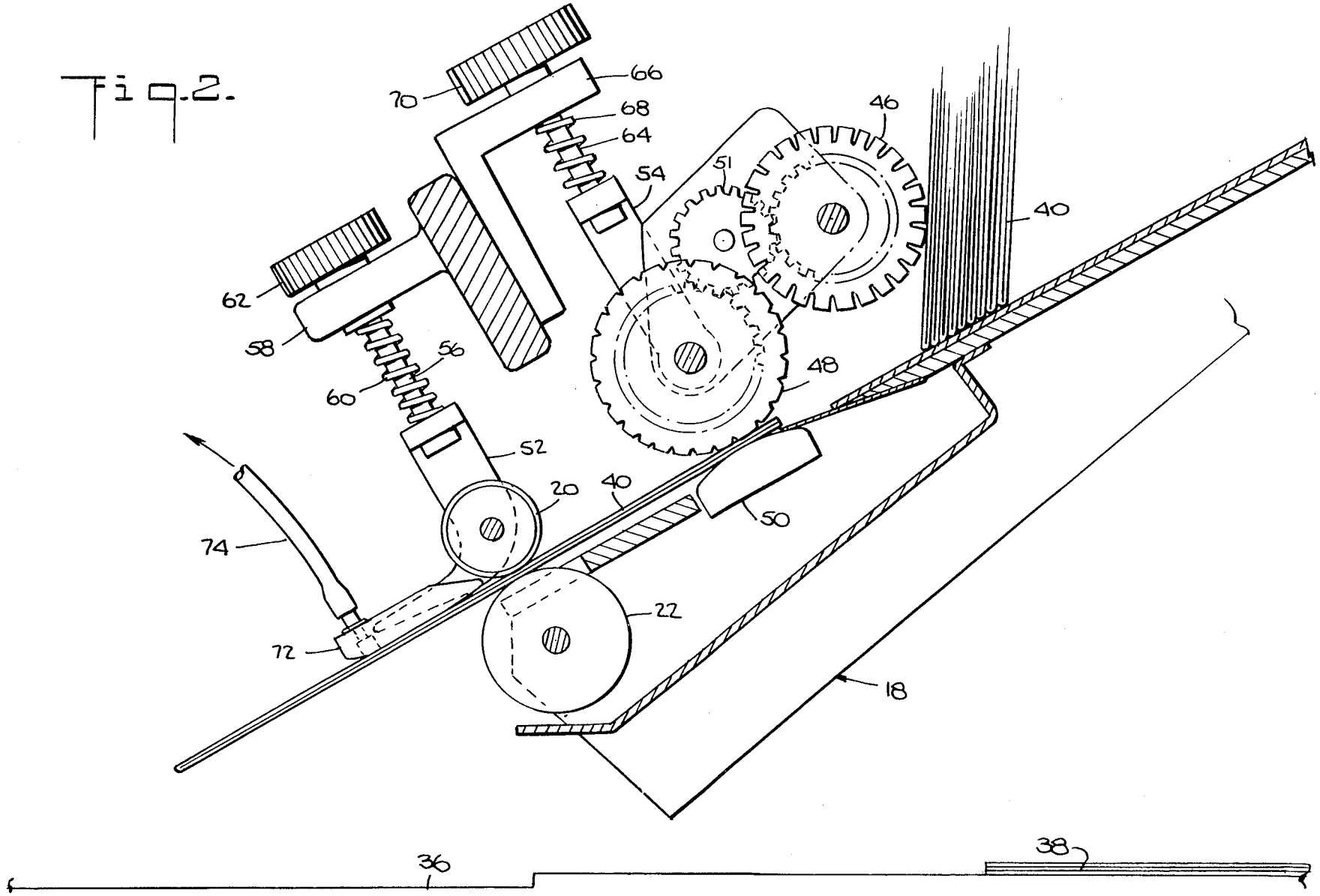
FIG. 2 is a side elevational view of the booklet feeder seen in FIG. 1 and shows a booklet being fed out of the feeder unit.
Figure 5:
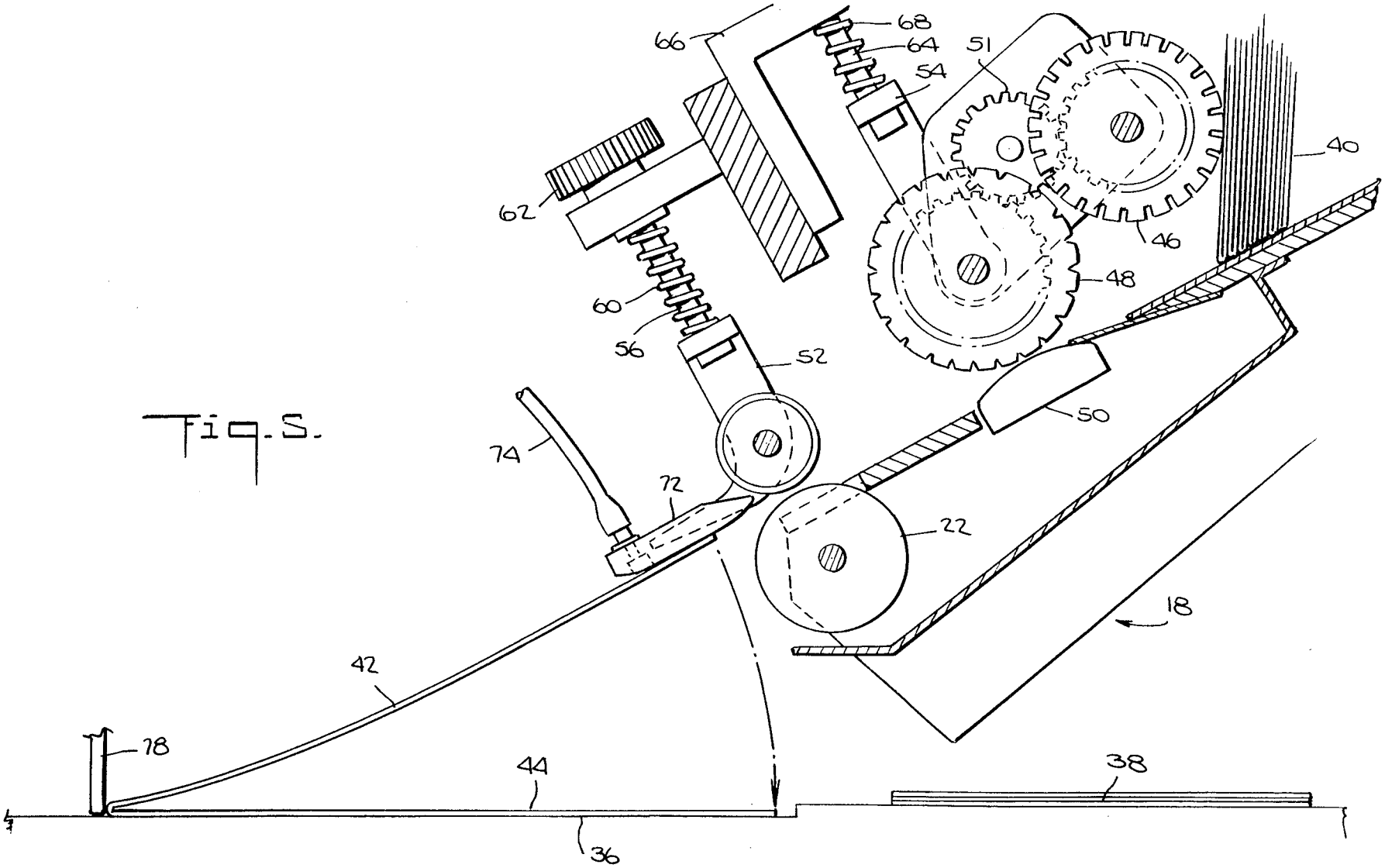
Figure 6:
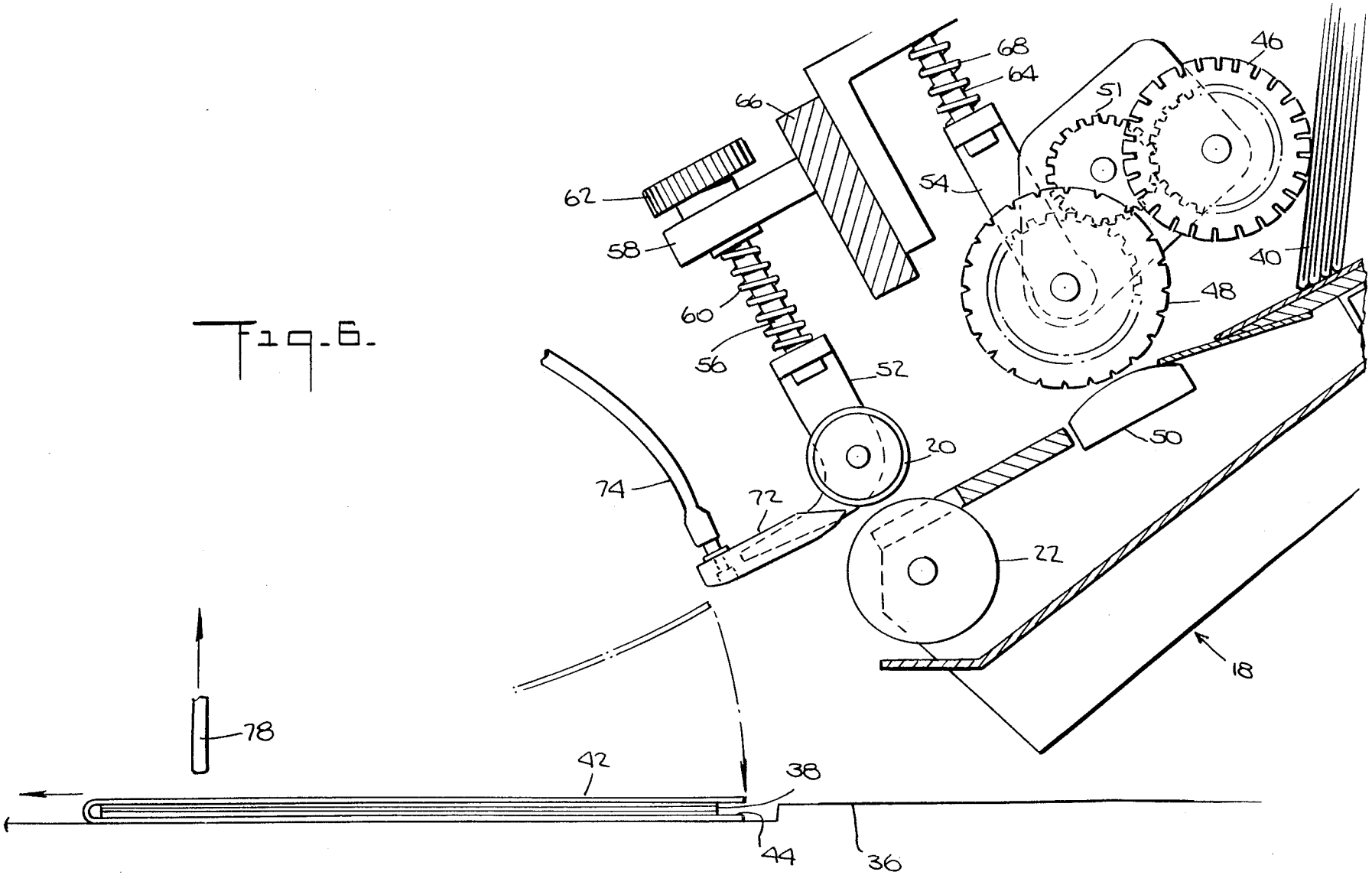
FIG. 6 is similar to FIG. 5 except that the sheet materials have been inserted into the booklet and have begun to move further downstream.

In operation, the vacuum supplied to the slot 76 is always on, and depending on the thickness of the booklets 40 being fed from the bin 42, the rollers 20 and 48 are raised or lowered to the appropriate height. The documents 24, 26 and 28 are assembled into a packet of documents 38 in conventional manner on the transport deck 36 and urged downstream to the position seen in FIG. 1. Just prior to the arrival of the packet 38 adjacent the booklet feeder 18, a booklet 40 is fed from the storage bin 41 past the vacuum block 72 as seen in FIG. 2. The demand feed rollers 20 and 22 continue the feeding of the booklet 40 to the transport deck 36, where a stop 78 halts the advance of the booklet 40, as seen in FIG. 5, where it can also be seen that the vacuum generated through the slot 76 effects an opening of the booklet 40 by holding the front cover 42 in an angled, raised position while the bottom cover 44 falls to the transport deck 36. In this position, the booklet 40 can receive the packet 38 which is urged into and nested in the booklet 40. After the nesting has taken place, the stop 78 is raised in conventional manner and the nested booklet 40 containing the packet 38 is urged further downstream on the transport deck 36 in conventional manner, which causes the front cover 42 to fall downward onto the packet 38, as seen in FIG. 6.

The exemplary embodiments described herein are presently considered to be preferred; however, it is contemplated that further variations and modifications within the purview of those skilled in the art can be made herein. The following claims are intended to cover all such variations and modifications as fall within the true spirit and scope of the invention.

What is claimed is:

1. In a document feeder in an inserting machine, said inserting machine having a transport deck and being capable of nesting a plurality of sheet materials between the front and back covers of a booklet, and said document feeder having a demand feed roller for feeding booklets seriatim, the improvement comprising:

a vacuum block for lifting one of said covers of said booklet, said vacuum block fixedly located downstream of said demand feed roller and above the inserting machine transport deck, wherein one of the covers of a booklet is separated and raised when a booklet is fed out from said document feeder and passes under said vacuum block, therefy allowing other sheet materials assembled on the transport deck upstream of said document feeder to be nested between the front and back covers of said booklet.

2. The improvement of claim 1, wherein the transport deck is stepped downwardly in the direction of transport.

3. The improvement of claim 2, wherein said document feeder includes a storage bin.

4. The improvement of claim 3, wherein the document feeder includes a feeder roller for separating a single booklet from the plurality of booklets supported in said storage bin.

5. The improvement of claim 4, wherein the document feeder includes a separator roller and a separator stone situated downstream of said feeder roller for feeding said booklet to the demand feed roller.

6. The improvement of claim 5, wherein the demand feed roller comprises a demand feed driven roller, and wherein the document feeder additionally includes a demand feed idler roller adjacent said demand feed driven roller.

* * * * *